US007746192B2

(12) United States Patent
McIntyre

(10) Patent No.: US 7,746,192 B2
(45) Date of Patent: Jun. 29, 2010

(54) POLYHEDRAL CONTOURED MICROWAVE CAVITIES

(75) Inventor: Peter M. McIntyre, College Station, TX (US)

(73) Assignee: The Texas A&M University System, College Station, TX (US)

( * ) Notice: Subject to any disclaimer, the term of this patent is extended or adjusted under 35 U.S.C. 154(b) by 494 days.

(21) Appl. No.: 11/425,297

(22) Filed: Jun. 20, 2006

(65) Prior Publication Data

US 2007/0069126 A1 Mar. 29, 2007

Related U.S. Application Data

(60) Provisional application No. 60/692,286, filed on Jun. 20, 2005.

(51) Int. Cl.
*H01P 1/04* (2006.01)
*H05H 9/00* (2006.01)
*H01P 1/203* (2006.01)

(52) U.S. Cl. ..... 333/99 S; 33/227; 315/505; 505/210

(58) Field of Classification Search ..... 505/210, 505/700, 866; 315/500, 505, 5.41, 5.42; 333/227, 99 S
See application file for complete search history.

(56) References Cited

U.S. PATENT DOCUMENTS 5,280,252 A * 1/1994 Inoue et al. ..... 315/500
6,407,505 B1 * 6/2002 Bertsche ..... 315/5.41
6,883,359 B1 4/2005 Hartwig, Jr.
7,276,708 B2 * 10/2007 Barov ..... 250/396 R

OTHER PUBLICATIONS

Yinghua, Chen; Proch, D.; Sekutowicz, J.; The Slotted Cavity—a Method of Broadband Damping; XIV International Conference on High Energy Accelerators, Tsukuba, Japan; DESY M-89-20; Aug. 1989; pp. 9.

* cited by examiner

*Primary Examiner*—James Cho
(74) *Attorney, Agent, or Firm*—Conley Rose, P.C.

(57) ABSTRACT

Fabrication methods for contoured polyhedral cavities for particle acceleration are disclosed. The process may include: trimming flat sheets to a conformal shape; bending the sheets to form a contour that is axially curved and azimuthally flat; and joining the sheets to form a circumferentially polyhedral cavity that is configured to support a resonant electromagnetic field at cryogenic temperatures. The resulting cavity may have ductile or even brittle superconducting materials with an axially-oriented grain structure at each point on the circumference of the cavity. As part of the assembly process, the sheets may be bonded to a supporting substrate of thermally conductive material having integrated cooling passages. The supporting substrates may be configured to have electrical contact near the cavity openings while having a small gap near the equators of the cavity. Moreover, mode-coupling channels and waveguides may be provided to extract energy from undesired deflection modes.

21 Claims, 13 Drawing Sheets

POLYHEDRAL CONTOURED MICROWAVE CAVITIES

CROSS-REFERENCE TO RELATED APPLICATIONS

The instant disclosure claims benefit of U.S. Provisional Patent Application No. 60/692,286, filed Jun. 20, 2005, the content of which is incorporated by reference in its entirety.

REFERENCES INCORPORATED BY REFERENCE

The following list of references contains related teachings and disclosures relevant to the instant disclosure and is all hereby incorporated by reference in their entirety. Note that any embedded hyperlinks provided in the hyperlinks listed below are similarly incorporated by reference.

TESLA Technical Design Report, http://tesla.desy.de/new_pages/TDR_CD/; http://www.physorg.com/news4275.html;

J. D. Jackson, Classical Electrodynamics, $2^{nd}$. Edition, p. 77. Wiley, N.Y. (1999);

H. Padamsee, http://www.Ins.cornell.edu/public/CESR/SRF/BasicSRF/SRFBas14.html;

J. Matricon and D. St. James, *Phys. Lett.* 24A, 241 (1967);

H. Piel, *Proceedings of the CERN Accelerator School* 1988, S. Turner ed., DESY, Hamburg, West Germany, CERN 89-04, 149 (1988);

D. Moffat et al, *Proceedings of the 4th Workshop on RF Superconductivity*, Y. Kojima ed., KEK, Tsukuba, Japan, KEK-Report 89-21 (1989), also CLNS 89-934 (1989);

J. R. Delayen et al., *Proceedings of the 5th Workshop on RF Superconductivity*, D. Proch ed., DESY, Hamburg, Germany, DESY M-92-01, 376 (1992);

Q. X. Jia et al., "Materials and processes of metal-oxide films for coated conductors", DOE Wire Workshop, St. Petersburg, Fla., Jan. 19-20, 2005;

T. G. Holesinger et al., 'Microstructural development in high-Jc (IC) $YBa_2Cu_3O_7$ coated conductors based on ex-situ YBCO conversion processes', submitted to 2005 CEC/ICMC conference, Keystone, Colo., Aug. 19-Sep. 2, 2005;

A. Goyal, 'Grain boundary networks in RABiTS and significant enhancement of flux-pinning in YBCO and REBCO films on RABiTS', ibid;

Y. Huang et al., 'MOD YBCO Coated Conductor Flux Pinning Improvements, ibid;

D. Gorlitz, D. Dolling, and J. Kotzler, 'Determination of the in-plane microwave conductivity of superconducting films', Rev. of Sci. Instr. 75, 1243 (2004);

J. Einfeld, P. Lahl, R. Kutzner, R. Wördenweber and G. Kästner, 'Defects in YBCO films on $CeO_2$ buffered sapphire and $LaAlO_3$ and their impact on the microwave properties', Inst. of Phys. Conf. Ser. 167 (II) 25-28 (2000), http://www.kfa-juelich.de/isg/Woerdenweber/Seite2-hf1-Woerdenweber.htm;

M. Hatridge et al., "Coupled multiplier accelerator produces high-power electron beam for industrial applications", Proc. Conf. on Applications of Accelerators in Research and Industry, Denton, Tex. Nov. 14-18, 2002;

Alex Gurevic, "Enhancement of RF Breakdown Field of Superconductors by Multilayer Coating", Applied Physics Letters 88, 012511;

Hartwig et al., U.S. Pat. No. 6,883,359 "Equal Channel Angular Extrusion Method";

Mathaudhu et al., "Severe Plastic Deformation of Bulk Nb for Nb3Sn Superconductors", IEEE Transactions on Applied Superconductivity, Vol. 15, No. 2.

BACKGROUND

One of the most effective means of accelerating charged particles to relativistic speeds is the linear accelerator (linac). A linac is made of a series of resonant cavities. As a packet or bunch of particles, such as electrons, pass through each cavity in a linac, an intense electric field provides an acceleration gradient for the particles in order to increase their kinetic energy. With reference to FIG. 1, conventional cavities 100 for linacs utilize a cavity geometry that is surface of revolution having a cross section 102 along the axis 108. The cavities are lined with a conductive material, so that when electromagnetic wave energy is supplied to the cavities, the cavities will support one or more resonant standing wave patterns. The fundamental harmonic of electric 106 and magnetic 104 fields in each cavity 100 will provide the desired acceleration gradient along the central axis. This fundamental harmonic is referred to as the accelerating mode.

In the accelerating mode, also conventionally called the $TM_{100}$ mode, the electric field 106 is at a maximum at the central axis 108 of the cavity 100 and is directed parallel to the axis. This electric field 106 applies an accelerating force on the bunch of particles passing through the cavity. Moving farther away from the axis, the electric field 106 is curved toward the surface of the cavity 100 in order to satisfy boundary conditions with the surface of the cavity. At the equator (i.e., the largest radial extent from the central axis) of the cavity 112 the electric field 106 is at a minimum. At the iris (i.e., the smallest radial extent from the central axis) 114 the electric field applied to the cavity is the greatest since it is the closest point to the axis 108.

The magnetic field 104 and the electric field 106 are related according to the right-hand-rule. As shown in FIG. 1 the magnetic field is directed into the page at the top of the cavity 100 and out of the page at the bottom of the cavity 100. The magnetic field 104 is at a maximum at the equator of the cavity 112 and is at a minimum at the axis of the cavity 108. The value of the maximum magnetic field 104 is directly proportional to the maximum surface current density on the cavity shell. Also, the maximum magnetic field 104 at the equator of the cavity 112 strongly determines the maximum acceleration gradient of the cavity 100. Therefore the maximum surface current density of the cavity shell strongly determines the maximum acceleration gradient. Since this is the case, superconducting materials may be preferred as a cavity lining to enable a high surface current density and correspondingly a high acceleration gradient.

FIG. 2 shows a cross-section taken through the equator of the cavity 100. This cross-section shows a first harmonic wave pattern of the cavity structure. This first harmonic is detrimental to particle acceleration since it generates an electric field 202 that is transverse to the axis 108, causing deflection of the particle bunches passing through the linac. The surface currents 206 are determinant in the magnitude of the electric field for causing the deflection. These surface currents travel in an azimuthally oriented direction around the equator of the cavity 112. Various other higher order mode harmonics similarly create transverse effects to the particle bunches and are collectively referred to as deflecting modes or higher order modes (HOM).

The deflection of the particle bunches causes the dilution of the brightness of the particle beam, head to tail instabilities, multi-bunch coupling instabilities, etc. The harmonics of the deflecting modes are caused by misalignment of cavities or strings of cavities. FIG. 3 depicts multi-bunch coupling with the transverse electric field growth driven by deflecting modes that are excited when a bunch is displaced off-axis in the cavity. FIG. 4 depicts the head-to-tail instabilities caused when a bunch passes through a misaligned string of cavities. It is noted that in conventional cavity designs, these deflecting modes gain all of the advantages of the resonance that the fundamental mode has, and therefore generate a Q in the same order of magnitude as the Q for the fundamental harmonic.

The International Linear Collider (ILC) project has been endorsed as the next new facility for high energy research. The Teraelectronvolt Energy Superconducting Linear Accelerator (TESLA) technology has been chosen for the ILC project as the most cost-effective basis for the ~500 GeV linear accelerators (linacs). A second major project, the X-ray Free Electron Laser (XFEL) at the Deuches Electronen Synchrotron (DESY) in Hamburg, Germany, also utilizes the TESLA cavity structure. In both projects, the capital cost of a TESLA-based linac will be dominated by the cost of the Nb cavities and the associated cryogenics, power couplers, and radio frequency (RF) power systems. The operating cost of a TESLA-based linac will be dominated by the cost of refrigerating kilometers of accelerating structure to superfluid helium temperature.

The performance of a linac is determined by the accelerating gradient that can be sustained and by the beam brightness (emittance density) that can be sustained through the acceleration process. Dilution of the beam brightness can arise from instabilities in the particle motion through the linac and from the transverse forces due to deflecting modes in the superconducting cavities as was described above. It would be desirable to have an improved cavity design that intrinsically suppresses undesired deflection modes while simultaneously enabling the creation of cavity linings having substantially higher maximum surface current densities. Moreover, it would be desirable for such a cavity design to enable operation with more efficient refrigeration, thereby reducing capital and operating costs of high power linacs.

SUMMARY

Accordingly, there are disclosed herein contoured polyhedral cavities for particle acceleration and fabrication methods therefor. In some embodiments, a fabrication process comprises: trimming flat sheets of a first material to a conformal shape; bending the sheets to form a contour that is smoothly curved in an axial direction and flat in an azimuthal direction; and joining the sheets to form a circumferentially polyhedral cavity that is configured to support a resonant electromagnetic field at temperatures below a critical temperature of the first material. The resulting cavity may have ductile or even brittle superconducting materials with an axially-oriented grain structure at each point on the circumference of the cavity. As part of the assembly process, the sheets may be bonded to a supporting substrate of thermally conductive material having integrated cooling passages. The supporting substrates may be configured to have electrical contact near the cavity openings while having a small gap near the equators of the cavity. Moreover, some of the supporting substrates may be configured with mode-coupling channels and waveguides to extract energy from undesired deflection modes. Integral cooling passages may enable economically advantageous cooling of the structure. These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
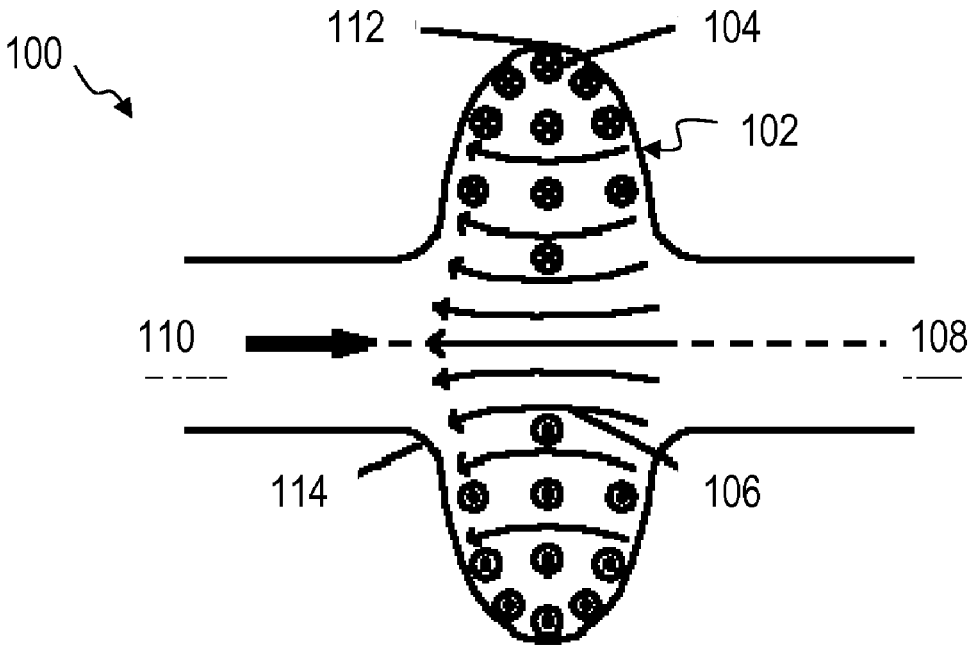
FIG. 1 shows a side view of an illustrative resonant cavity contour.
Figure 2:
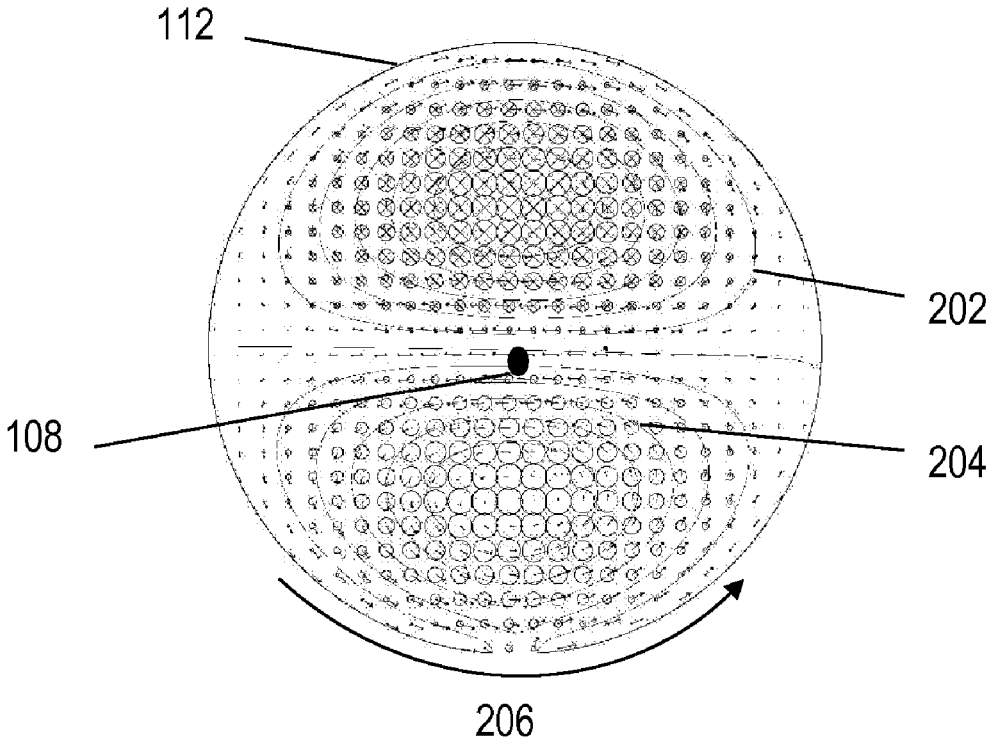
FIG. 2 shows an end view of the illustrative resonant cavity contour.
Figure 3:
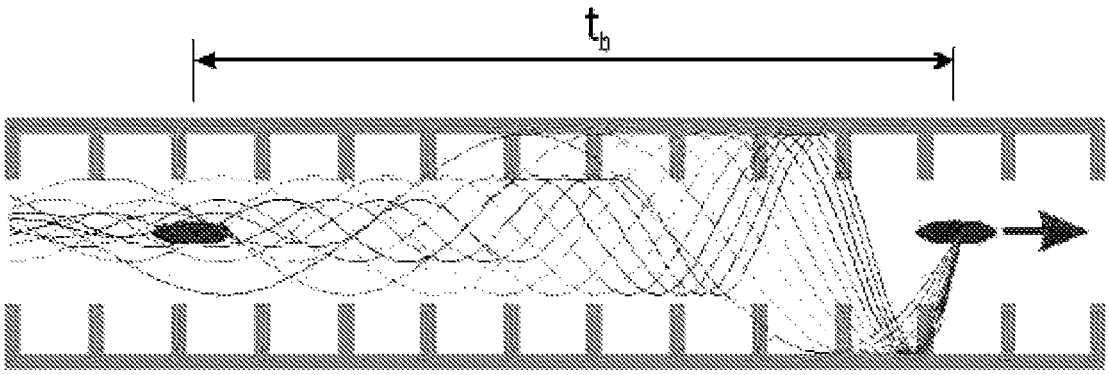
FIG. 3 shows illustrative transverse electric field growth driven by deflecting modes.
Figure 4:
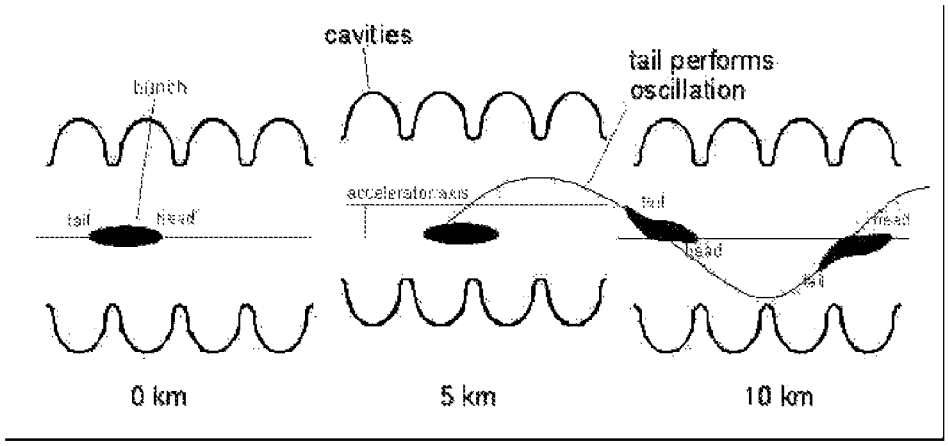
FIG. 4 shows illustrative the head-to-tail instabilities with misaligned cavity strings.

It should be understood at the outset that although an illustrative implementation of various embodiments of the present disclosure are illustrated below, the present system may be implemented using any number of techniques, whether currently known or in existence. The present disclosure should in no way be limited to the illustrative implementations, drawings, and techniques illustrated below, including the illustrative design and implementation shown and described herein, but may be modified within the scope of the appended claims along with their full scope of equivalents.

Disclosed herein is an improved structure for use in superconducting accelerator cavities. The structure is an axially symmetric polyhedral cavity composed of N identical segments, each comprising a wedge of base material that is axially contoured to form a portion of the cavity that approximates the desired surface of revolution. The axially contoured portions are azimuthally flat and provided with a superconducting surface. The inner surface of each segment is readily accessible for processing and inspection, enabling the use of various techniques for customizing the superconducting surface in a fashion that increases the maximum surface current density. The geometry of the inner contours further enables custom tailoring of the superconductor grain structure to promote current flows that support the fundamental mode while disfavoring current flows that support deflection modes.

Further disclosed herein is a polyhedral cavity fabrication process that is able to align the grain structure of the superconducting material in an axial direction in order to increase the maximum acceleration gradient of each of the cavity cells. Also, since the fabrication generates a plurality of segments with an open geometry a number of surface treatment and quality control measures may be applied to the superconducting material. As segments are joined to form a linac cavity, welding is performed at some distance from the superconducting surfaces, thereby enabling the superconducting surfaces to remain unaltered by the welding process. Since the segments are joined in an azimuthal direction, they suppress surface currents that flow azimuthally across segment boundaries, and therefore reduce the Q of the deflecting modes. With the superconducting material being bonded to a brick of supporting copper, the linac cavities are insensitive to the significant Lorentz forces resulting from large acceleration gradients, thus avoiding the problem of Lorentz detuning that may be expected with other construction techniques. Furthermore, one or more cooling channels may be created in the copper in order to eliminate the need for an immersive cryogenic bath since the cryogenic coolant is instead simply passed through each of the cooling channels.

Also disclosed herein is an alternative polyhedral segment geometry in which there are channels that electromagnetically couple out RF power created by the deflecting modes to a waveguide. The waveguide can then transmit the RF power to a resistive load in an external, room temperature environment, thereby reducing the cryogenic refrigeration load. The channel also provides a vacuum or dielectric gap at the equator of the cavity which prevents surface currents from traveling across each of the polyhedral segments and therefore reduces the Q of the deflecting modes.

Nb Half-Cells

To more clearly explain the features and advantages of the preferred linac cavity fabrication process, less desirable fabrication processes loosely based on existing technology are first described with reference to FIGS. 5 and 6. Each cavity cell is fabricated by deforming a flat sheet of Niobium (Nb) into the contour of a half-cell, then assembling two such half-cells and joining them using electron-beam welding, for example, shown at lines 502. Nb is a low-temperature superconductor that is ductile at everyday temperatures. Because of this ductility, a sheet of Nb can be deformed through a process of spinning that creates a thin foil of Nb in the half-cell structure. This procedure can only be done using ductile superconducting materials.

As was mentioned above, the maximum acceleration gradient is in large part determined by the maximum surface current density that can flow axially across the equator on the inside surface of the cavity. Creating a weld along the equator perpendicular to the axis of the cavity causes the melting and recrystalization in the heat-affected zone around the weld. It has been found that the current carried across superconducting materials is very sensitive to the grain structure and direction of the grain in the material. In particular, currents flow better when they travel in a direction parallel to the grain of the material and with longer textured grains. The recrystalization of the Nb causes the grains to be reoriented such that they may no longer be oriented in the axial direction. (Even assuming the original Nb sheet had uniformly oriented grains, the resulting cell will not have grains at the equator with a uniformly axial alignment.) Also, the surface chemistry of the Nb changes due to interactions with the atmosphere and the weld as well as impurities within the Nb percolating to the surface, among other changes. The combination of the grain and surface chemistry changes to the Nb cavity greatly degrades the ability to carry currents in the axial direction which support the fundamental harmonic mode, i.e., the accelerating mode, needed to generate the acceleration gradient. Thus the maximum acceleration gradient is greatly reduced by the placement of the welding along the equator of the cavity and the necessity to weld the Nb itself.

Figure 5:
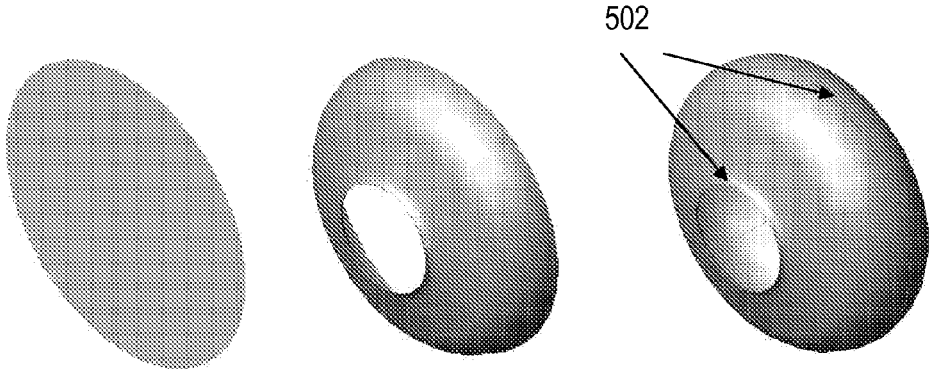
FIG. 5 shows an illustrative fabrication process for forming Nb half-cells.
Figure 6:
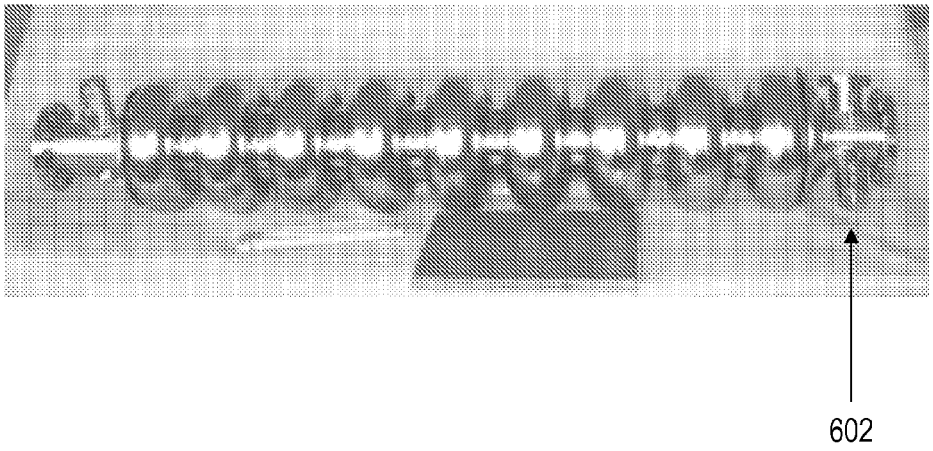
FIG. 6 shows an illustrative nine-cell linac cavity.

Shown in FIG. 6 is a complete nine cell linac using the fabrication method described in conjunction with FIG. 5. As was mentioned above, the performance of the linac is affected in part by deflection modes, or higher order mode harmonics, in the cavities. In order to correct for the deflecting modes, the linac may have Higher Order Mode (HOM) couplers 502 that couple out the HOMs and therefore reduce the Q of the deflecting modes. This may be accomplished by applying a resistive load to the HOM couplers 502. The Q of the deflecting modes may be reduced in the Nb cavity depicted in FIG. 6 from $\sim 10^{10}$ of down to $\sim 10^{5}$, for example.

One problem associated with constructing the linac cavities with the Nb foil as described above is keeping all of the cavities in resonance. With high acceleration gradients, Lorentz forces caused by the particles moving through the linac cavities create an "electromagnetic pressure" that pushes outward on the entire cavity. The electromagnetic pressure may be analogized to steam applying pressure inside an enclosed pipe except this pressure is determined based on the electromagnetic fields and therefore is largest at the equator of each cavity. Since the Nb is a thin foil these Lorentz forces may cause deformation of the cavity, thereby altering the resonance frequency and reducing the Q of the fundamental mode. This Lorentz detuning may take place by only deforming the surface of the cavity as little as one part/billion. Unwieldy compensation techniques have been proposed to enable operation at high acceleration gradients. For example, piezoelectric actuators may be placed along each of the cavities and driven so as to apply a compensating force on the outside of the cavity to correct for Lorentz forces and prevent detuning.

In order for the Nb to act as a superconductor it must be cooled to liquid helium temperatures. In order to accomplish this, the Nb cavity may be immersed in a cryostat that provides a superfluid He bath. Creating and maintaining the superfluid He is very expensive and may represent as much as ⅓ of capital costs for constructing a linac such as those required for ILC and XFEL. Further, the operational expenses for maintaining the He as a superfluid are also very high.

Nb Coating

In an alternative, but still undesirable fabrication process, a copper (Cu) structure is fabricated by spinning a sheet of Cu into the shape shown in FIG. 5, assembling the half-cells to form a multi-cell string as shown in FIG. 6 and then using magnetron sputtering, chemical vapor deposition (CVD), or some other means to deposit a thin film of superconducting material such as Nb on the inside surfaces. While solving the problems associated with the weld there is still no way to align the grains of the Nb in an axial direction in this process. Also, while a Cu backing is provided to support the Nb this layer of Cu is thin and still subject to the effects of the Lorentz forces. Further, this alternative procedure does not address any solutions to reducing the deflecting modes or to provide better cooling to the Nb.

Various effective surface conditioning and quality control measures exist which could be used to improve the maximum surface current density at the equators of the linac cell cavities. Unfortunately, these measures cannot be applied effectively with the Nb half-cell or Nb coating fabrication processes since these measures would have to be performed in an enclosed cavity structure. An effective quality control inspection may be performed by infrared laser spectroscopy, however this technology would not be able to be used in the enclosed cavity structure since the laser may not be directed to the inside surfaces of the enclosed cavity structure.

Figure 7:
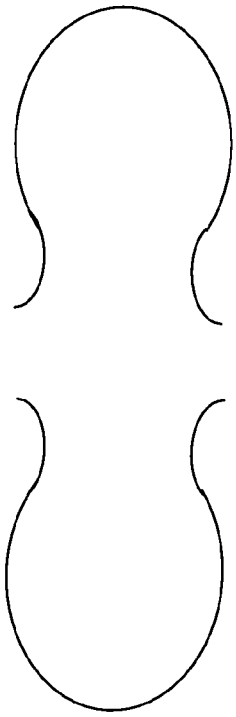
FIG. 7 shows another illustrative resonant cavity contour.

Also, it has been found that, rather than the convex cross-section shown in FIG. 1, the preferred cavity geometry may have a somewhat more "re-entrant" shape such as that shown in FIG. 7. This geometry may be beneficial to increasing the accelerating gradient. This re-entrant shape tends to trap pools of liquid chemicals in each chamber, making it extremely difficult to perform consistent chemical-based surface conditioning techniques. None of the above described fabrication processes improve the ability to remove or reduce the deflecting modes or improve the ability to cool the linac. While the cavity geometries shown in FIGS. 1 and 7 have been described above, it is noted that other acceptable cavity geometries exits and may be used.

Polyhedral Cells

Figure 8:
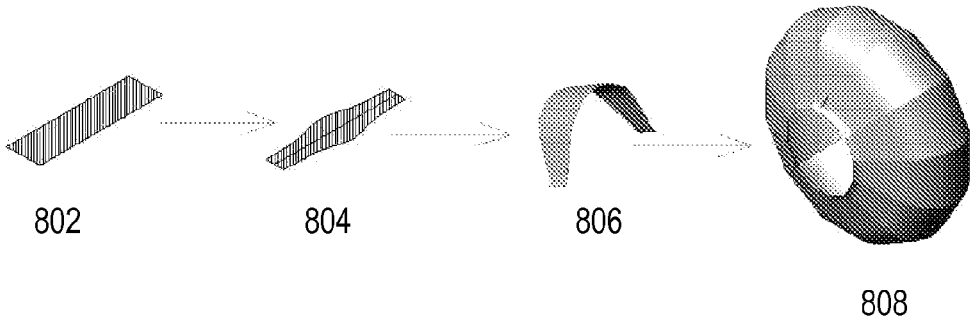
FIG. 8 shows an illustrative fabrication process for forming polyhedral cells.

FIG. 8 shows a novel linac cell fabrication process that offers a number of distinct advantages over existing fabrication processes. Each face of the polyhedral cavity, which is dodecahedral in the example shown in FIG. 8, is fabricated from a flat strip of superconducting material 802. In this procedure the flat sheet may be trimmed 804 to the contour that will be required for it to form the face of the polyhedral surface. The trimmed sheet 804 may then be bent in the easy direction into a form that gives it the surface contour 806 that corresponds to the contour depicted in FIG. 1. (Note that the trimmed sheet 804 may alternatively be formed to the contour of FIG. 7.) While the trimmed sheet 804 is held in the contour 806, it can be annealed to relieve internal stresses caused by the bending process. The curved contours 806 may then be assembled together to form the polyhedral linac cell 808. In the embodiment of FIG. 8, electron beam welding may be used to join the contours. However, as will be explained further below, this assembly technique does not require the molecular-scale bonding of a weld, allowing other assembly techniques to be viable alternatives.

This linac cell 808 eliminates the azimuthally-oriented weld at the equator used in the half-cell technique and therefore promotes the surface currents in the axial direction for the accelerating mode. As such, this method of fabricating a linac cell provides for a higher acceleration gradient than the half-cell fabrication method. Further, since each of the trimmed sheets 804 are attached using a weld (or other joint) that is oriented in the axial direction, the currents in the azimuthally oriented direction around the equator are reduced, similar to the way the weld in the half-cell construction reduced the currents in the axial direction. By weakening the currents in the azimuthally oriented direction, the Q of the deflecting modes is reduced and thus their influence on the particle bunches is likewise reduced. Note that this reduction in the Q of the deflecting modes takes place without the need for the HOM coupler described previously with respect to FIG. 6.

Also, since this fabrication process is started from a flat sheet of superconducting material, the surface finish and grain structure may be improved using processes that are not available with the above described processes. In particular, the contoured segments 806 may be treated to provide optimal surface chemistry, grain structure, and grain direction around the equator in the axial direction.

The foil structure illustrated in FIG. 8 may be susceptible to the Lorentz forces similar to those experienced using the half-cell fabrication technique. As such, it may be beneficial to bond the superconducting material to a rigid surface such as copper as described below with reference to FIG. 9. Not only does bonding the superconducting material to copper provide structural stability, but copper is a very good heat conductor and aids in the cooling of the superconducting material.

Polyhedral Cavity

Figure 9:
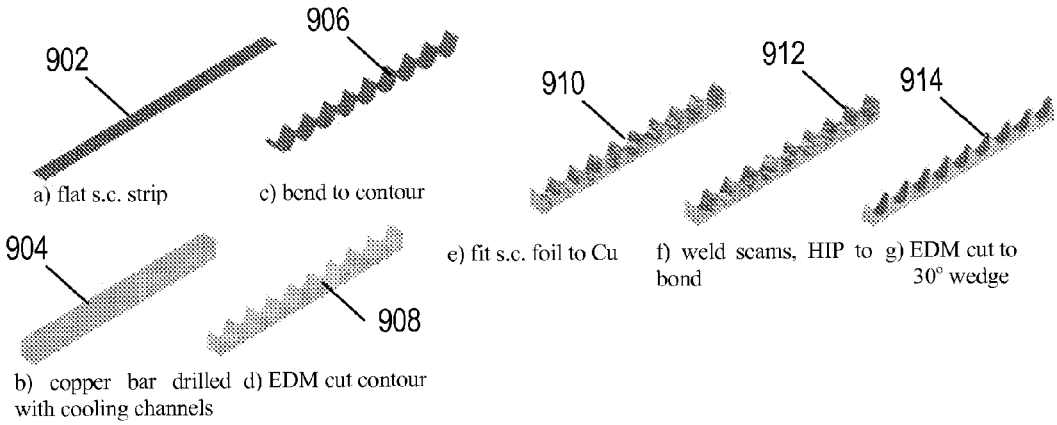
FIG. 9 shows an illustrative fabrication process for forming polyhedral segments.

The entire string of cavity cells that constitutes an accelerator unit could be fabricated using continuous strips for each face, as shown in FIG. 9. This procedure may minimize the number of parts to fabricate and the number of assembly steps as compared with creating the polyhedral cells. FIG. 9 depicts a process of fabricating each polyhedral segment of a linac. In the example shown in FIG. 9 a dodecahedral linac may be formed with nine cavity cells that may be used to support the 1.3 GHz TESLA used in the linacs for ILC and XFEL. It is noted that any other polyhedral cavity may be formed such as an octahedral, though of course the internal fields more closely approximate those of azimuthally smooth cavities when more sides are used.

As shown in FIG. 9 a flat sheet of superconducting material, such as Nb, may be formed with a desired grain structure in the longitudinal direction. Such sheets are commercially available and may be constructed using the extrusion method of Hartwig et al., U.S. Pat. No. 6,883,359.

Figure 19:
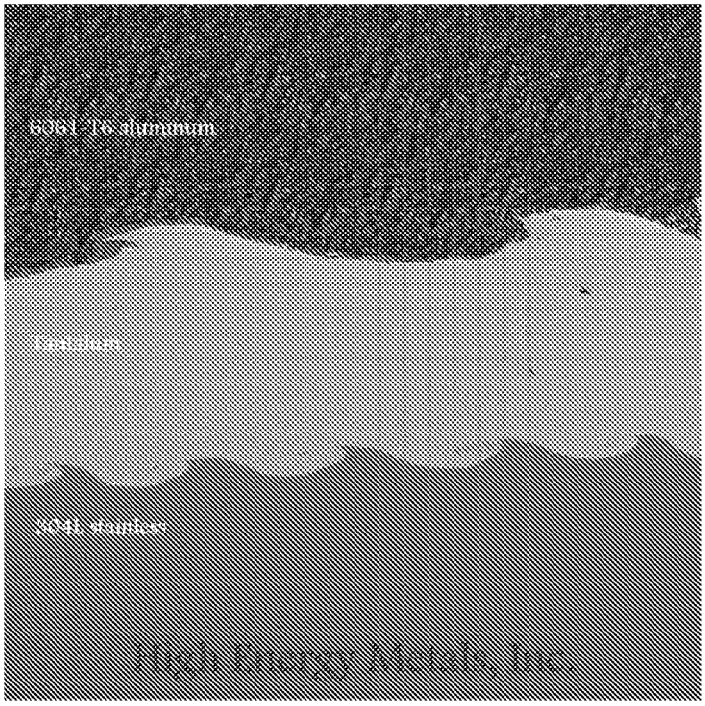
FIG. 19 shows an illustrative view of a metallurgical bond created by explosion bonding.
Figure 20:
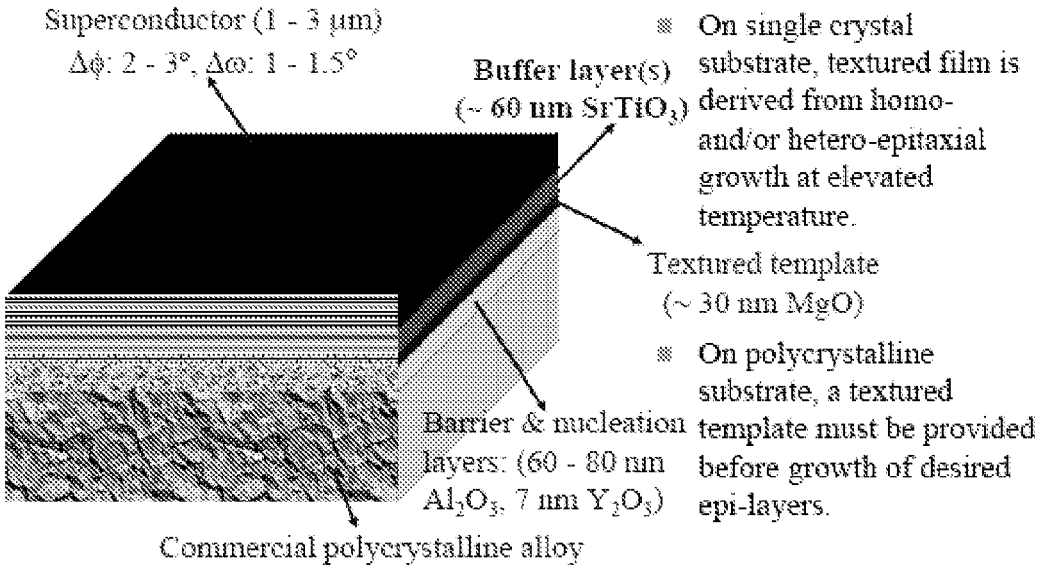
FIG. 20 shows an illustrative cross section of a flat strip of YBCO.

The sheet of material may be wholly a superconducting material, or it may be a layered material comprising one or more superconducting layers and a substrate layer. In some alternative embodiments, for example, the sheet of material comprises a superconducting material that has been bonded to a copper substrate layer using an explosive bonding technique. Explosive bonding is a procedure in which two foils are cleaned and stacked face-to-face. A sheet of sacrificial aluminum plate is then glued to the stack and a sheet of plastic explosive is placed on top. The explosive is detonated from one end of a long strip of such an assembly. The shock wave from the propagating explosion instantaneously melts the two metals at their interface so that intimate metallurgical bonding is attained. FIG. 19 shows a micrograph showing the bonding for an example 3-layer laminate, produced in the work of High Energy Metals, Inc. shown at the website www.highenergymetals.com.

From the flat sheet a rectangular strip 902 of superconducting foil is cut with sufficient length to accommodate the arc length along the curved surface of the desired module of cavity cells, and sufficient width to provide the width of each segment of the finished cavity within an acceptable margin of error on both sides. A copper brick 904 may then be cut to the same length and width as the rectangular strip 902, and with a sufficient depth to provide for the full radial excursion of the cavity surface plus additional depth to provide for structural integrity and cooling channels. The copper brick 904 may then have one or more cooling channels drilled near the bottom of the brick, which will be discussed in more detail herein below.

The superconducting material 902 may then be curved to a desired contour 906 for each of the cavity cells, such as the contour shown in FIG. 1 or FIG. 7. A mechanical bending process and/or a pressure forming process may be used to shape the superconducting material. In the azimuthal direction, the contoured material 906 remains flat. The copper brick 904 may then be machined using any appropriate technique, such as electric discharge machining (EDM), to produce a copper base 908 that conforms to the contoured superconducting material 906. The contoured superconducting material 906 and the copper base 908 may then be joined together, perhaps by welding along the edges of the contact between the copper and superconducting material to form an integral superconducting and copper contour 910. The integral contour 910 may then be metallurgically bonded in a number of ways.

Figure 10:
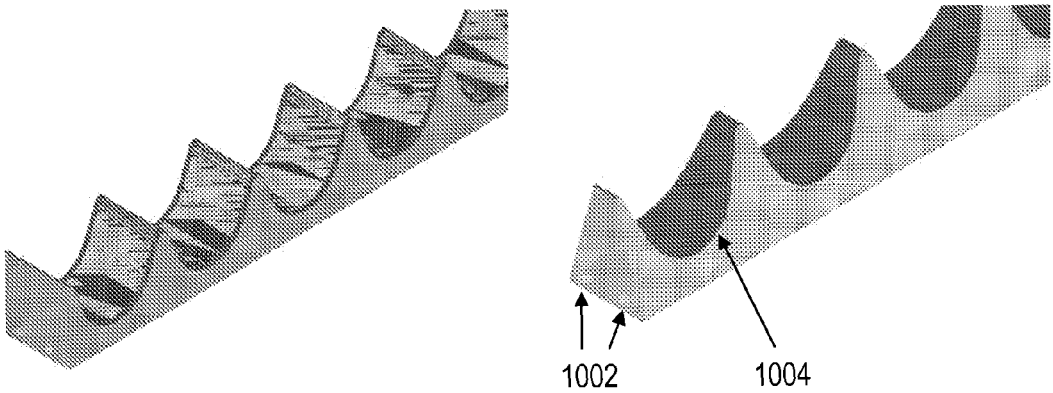
FIG. 10 shows an end view of an illustrative polyhedral segment.

In some embodiments, a hot isostatic pressure (HIP) bonding process is used to bond the contoured material to the base, perhaps with welding along the edges of the material. In other embodiments, the contoured superconducting material has a copper substrate, which can be eutectically bonded (soldered) to the copper base. The metallurgical bonded contour 912 may then be trimmed, according to the appropriate angle for joining with corresponding contours 912 to form the enclosed polyhedral cavity, to form a trimmed contour (or "segments") 914. In the example of FIG. 9, since a dodecahedral cavity is being formed, then each side of the bonded contour 912 is trimmed along a 15° angle as shown in FIG. 10.

As part of the HIP bonding process, it is noted that prior to welding the superconducting material and the copper, one or more holes may be drilled through the copper along the contour. When the superconducting material is placed on the copper a vacuum seal may be created between the superconductor and the copper through applying a vacuum to each of the drilled holes. In this manner the probability of void formation during the bonding process is reduced. The formation of voids may be detrimental to maintaining the resonant tuning in the polyhedral cavity in that the void areas will be sensitive to Lorentz forces.

Figure 11:
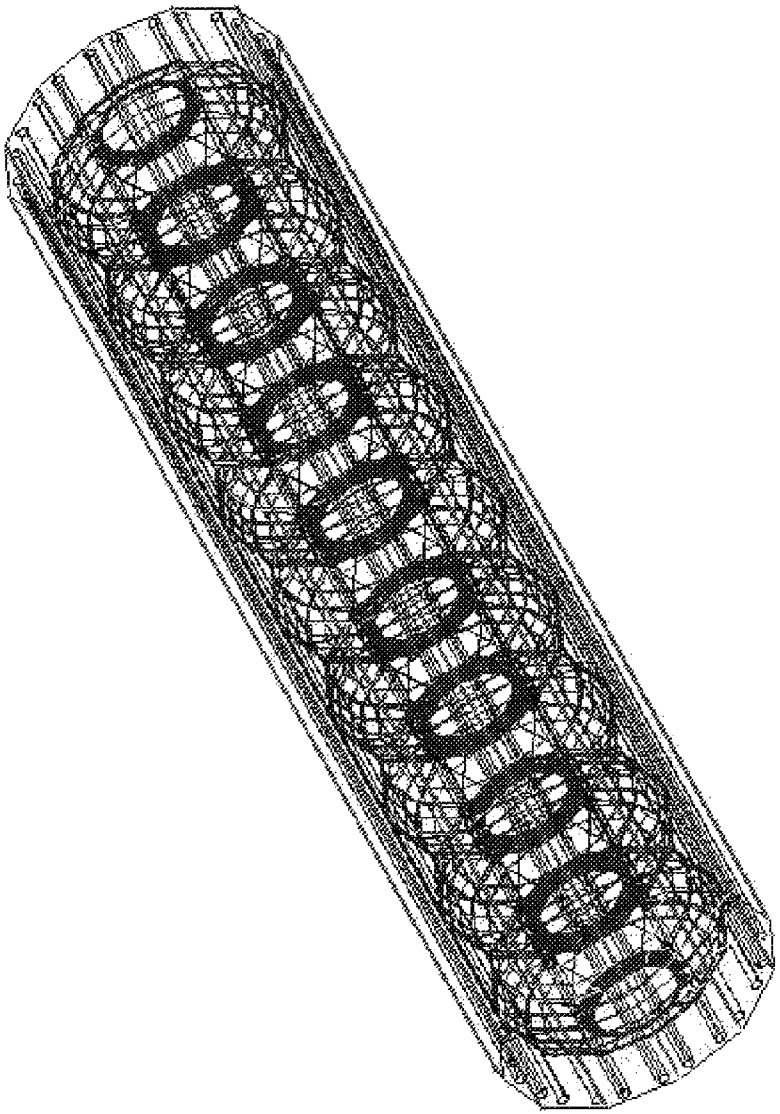
FIG. 11 shows an illustrative lattice view of a dodecahedral linac cavity.
Figure 12:
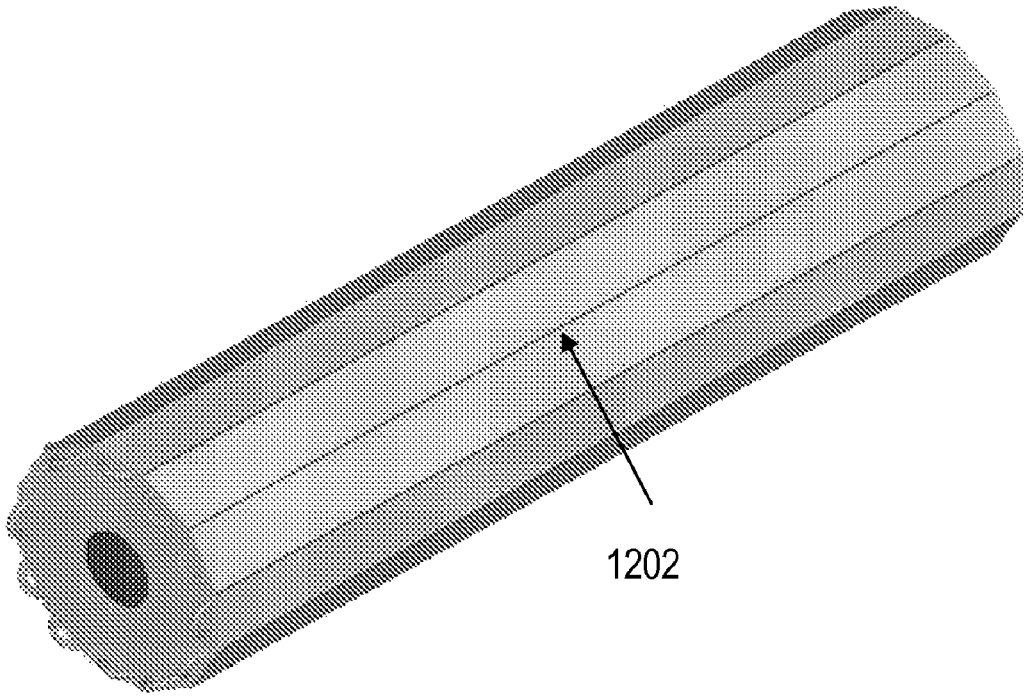
FIG. 12 shows an illustrative exterior view of the dodecahedral linac cavity.

FIG. 11 shows a wire-frame view of the interior structure of a fully constructed dodecahedral linac cavity. FIG. 12 shows an exterior view of the fully constructed dodecahedral linac cavity. Welds may be created along the external copper joints 1202 in order to hold each of the linac cavity segments in correct alignment to each other. It is noted that the welds need not be continuous, and in fact, tack welds may be used to minimize any stresses caused by the welding process. It has been found that gaps between the segments on the order of 0.1 mm at the equators of the cavity are desirable for the suppression of undesired higher order modes, though it is desirable to preserve electrical contact between the segments near the irises between cavities.

Since each of the segments 914 possess an open geometry they may then be easily subjected to quality control and surface treatment measures. For example, not only could quality control now be performed by infrared laser spectroscopy but the surface characteristics and chemistry may be thoroughly studied to gain improved insight to the factors which affect the acceleration mode and deflection modes. Also, a larger number of surface treatment processes are now available because of the open geometry.

Similar to the polyhedral cells, the polyhedral cavity provides the added benefit of reducing the azimuthally oriented currents responsible for the deflecting modes. Also, since this process starts from a flat sheet of superconducting material the grain structure and axial orientation may be preserved. Further, since the superconducting material is bonded and therefore supported by a solid copper structure the Lorentz forces do not affect the structure of the superconducting material. Therefore the cavities remain optimally tuned without the need for piezoelectric actuators.

An added benefit of bonding the superconducting material to the solid copper structure is the ability to drill cooling channels in the copper base, such as the cooling channels 1002 illustrated in FIG. 10. This cooling method eliminates the need to create cryostat chambers for totally immersing the linac cavity and reduces the amount of coolant needed. Moreover, having the cooling channels integral to the copper base minimizes resistance to thermal transfer between the segment and the coolant.

Since the polyhedral cavity fabrication process does not destroy the grain structure of the superconducting material, various processes may be applied to the superconductor for improving the grains and orienting them in a desired direction. One such process may be Equal Channel Angular Extrusion (ECAE). An article in IEEE Transactions on Applied Superconductivity, Vol. 15, No. 2, titled "Severe Plastic Deformation of Bulk Nb for Nb3Sn Superconductors", by Mathaudhu et al., describes a process of ECAE as applied to Nb in order to provide improved grain texture and length, the entire contents are hereby incorporated by reference. Upon the Nb being textured as desired it may be rolled into a flat sheet and is preferably bonded to a copper substrate as described above. U.S. Pat. No. 6,883,359 "Equal Channel Angular Extrusion Method" by Hartwig et al., describes another process for performing ECAE, the content of which is hereby incorporated by reference in its entirety.

In this fashion, the starting superconducting material may be customized to obtain optimal grain texture, length, and direction. The Nb may then be metallurgically bonded with a copper sheet and the bonded metals may then be further rolled (along the grain direction) to produce a thin layer of Nb with a thicker layer of Cu. The rolled sheet of metals may be cut into strips similar to that of 902, with the grains oriented along the long axis of the strips. The strip may be contoured and eutectically bonded to a contoured copper base as previously described with reference to FIG. 9. A suitably shaped die set may press the contoured strip against the contoured copper surface as the copper base is heated to the flow temperature of the eutectic solder. The segment is then fully bonded and ready for subsequent slicing and machining of the side faces that form the polyhedral wedge as shown in FIG. 10.

Figure 13:
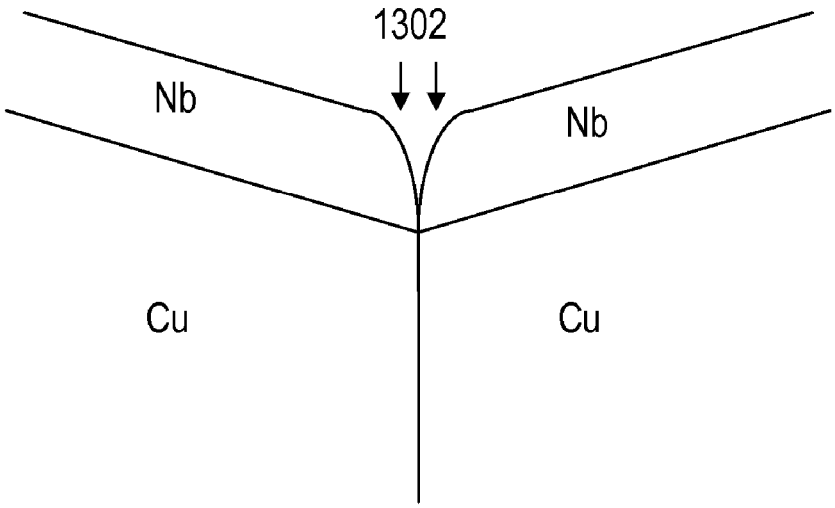
FIG. 13 shows an illustrative view of two abutting polyhedral segments with the superconducting material rounded at the corners.

It is noted that sharp discontinuities in the superconductive lining of the segments are undesirable, such as the corner of the superconducting material at the edge 1004 (FIG. 10) between the superconducting material and the face of the polyhedral segments. If the corner of the superconducting material is left at a (nearly) right angle then the Q of the accelerating mode may be reduced as much as by a factor of 100. To address this issue, the superconducting material may be rounded off at the corners 1302 as shown in FIG. 13. A circular radius of no less than 0.1 mm enables the electric field to fall off in a non-singular way and therefore preserves the Q of the accelerating mode to be fully equal to the best Q obtained for the TESLA structure (FIGS. 5, 6). While a circular geometry of the corners is discussed above, any other appropriate geometry may be used.

Figure 14:
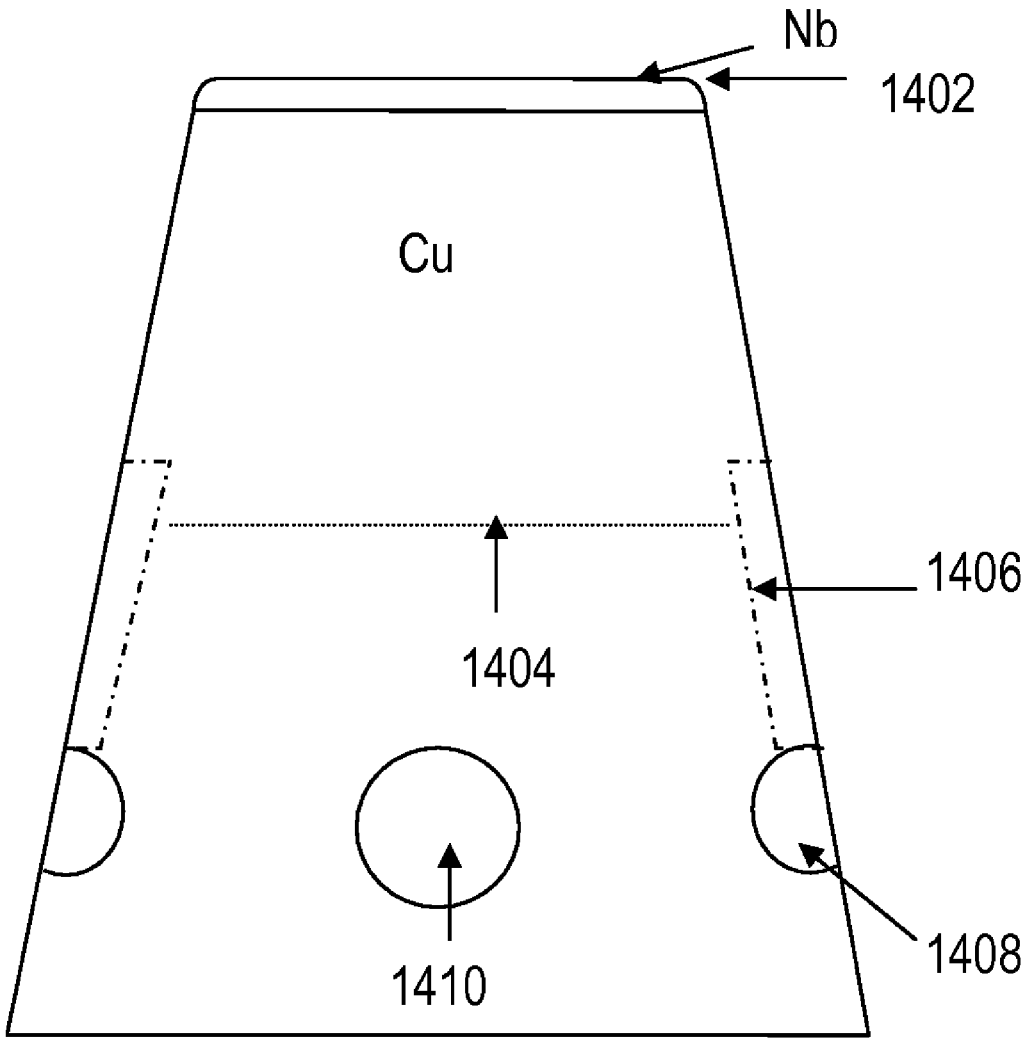
FIG. 14 shows an end view of an alternative polyhedral segment geometry.

FIG. 14 depicts an end view of an alternative polyhedral segment geometry that may be contrasted with the one shown in FIG. 10. As depicted in FIG. 14, the Nb is bonded to the copper base with the corners 1402 rounded off as described above. The dashed line 1404 represents the equator of the Nb contour where the surface currents for supporting the deflecting modes travel horizontally across the page. In order to further reduce the Q of these deflecting modes a narrow slot 1406 may be cut out of the polyhedral segment to provide a mode-coupling channel between the equators of each polyhedral segment. Currents traveling in an azimuthal direction will generate field energy transversely across the slots, thereby coupling energy from the deflection modes into the mode-coupling slot.

Figure 17:
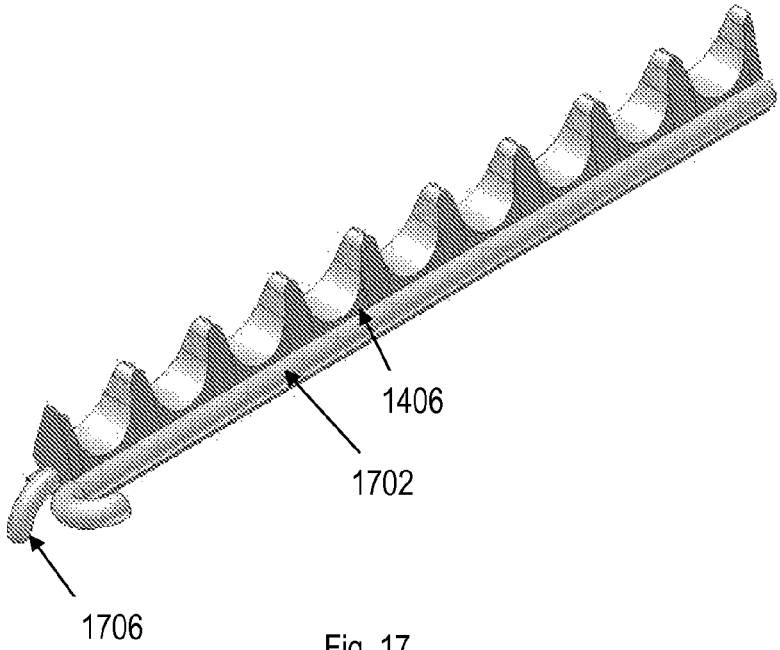
FIG. 17 shows a three-dimensional rendering of a polyhedral segment with the alternative geometry.
Figure 18:
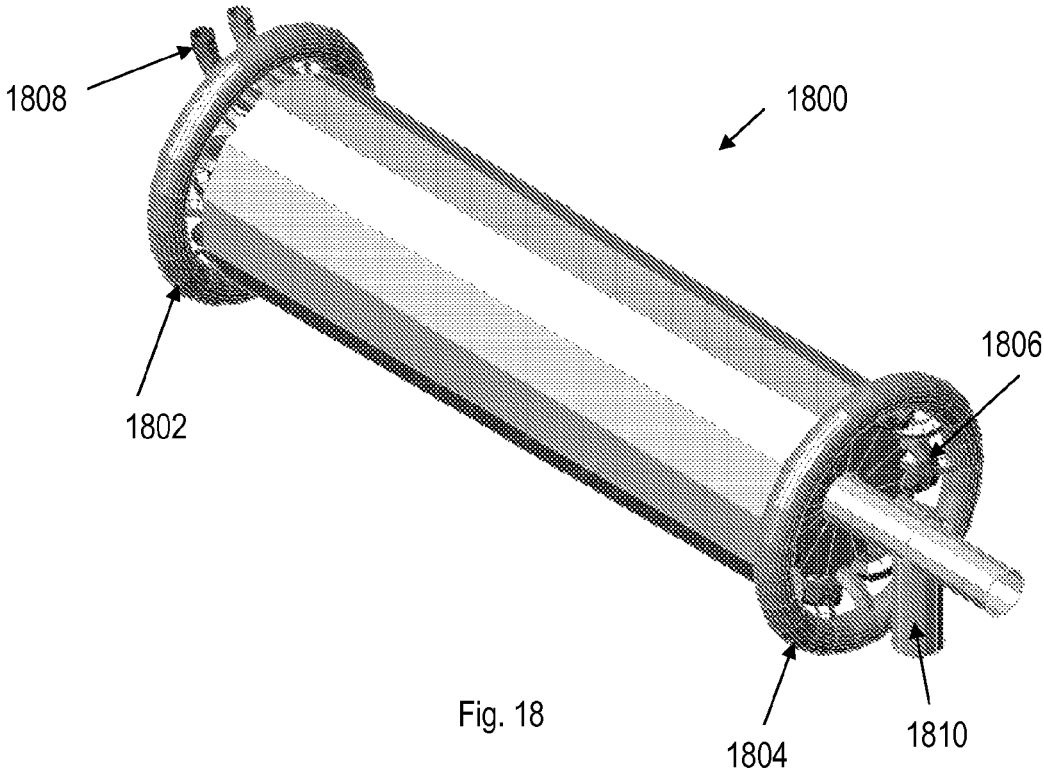
FIG. 18 shows an exterior view of an assembled linac cavity using the alternative polyhedral segment geometry.

As the azimuthally oriented current approaches the slot 1406, it is transformed into a displacement current; hence an electric field flux is generated in the slot 1406. The outer end of the mode-coupling slot connects to a cylindrical or coaxial waveguide 1408 running axially along the length of the segment. The waveguide 1408 is formed in the joint between adjacent segments. The waveguide 1408 serves to efficiently transport RF power from any deflecting mode to the ends of each linac cavity segment. At the end of the linac cavity segment the power from each such waveguide can be coupled out to a room-temperature resistive termination, or alternatively the N waveguides in the joints of a linac cavity segment can be connected together end-on-end by means of U-shaped waveguide segments that maintain constant RF impedance while transporting the traveling electromagnetic wave within through a 180 degree bend to connect it to the next waveguide, as shown in FIGS. 17 and 18. In the case of serially connected waveguides the ends of the series can be brought out to a room-temperature resistive termination, thereby keeping to a minimum the number of cold-to-warm waveguide transitions that are required. In this way the considerable amount of RF power that may be coupled into deflecting modes is not resistively dissipated as heat in the cold cavity walls, but instead is dissipated externally so that it does not cause additional heat loading in the linac cavity refrigeration system. As opposed to creating two cooling channels as was the case for the polyhedral segment geometry in FIG. 10, a single cooling channel 1410 may be used in this alternative geometry in order to accommodate for the apertures 1408 of the waveguide.

Figure 15:
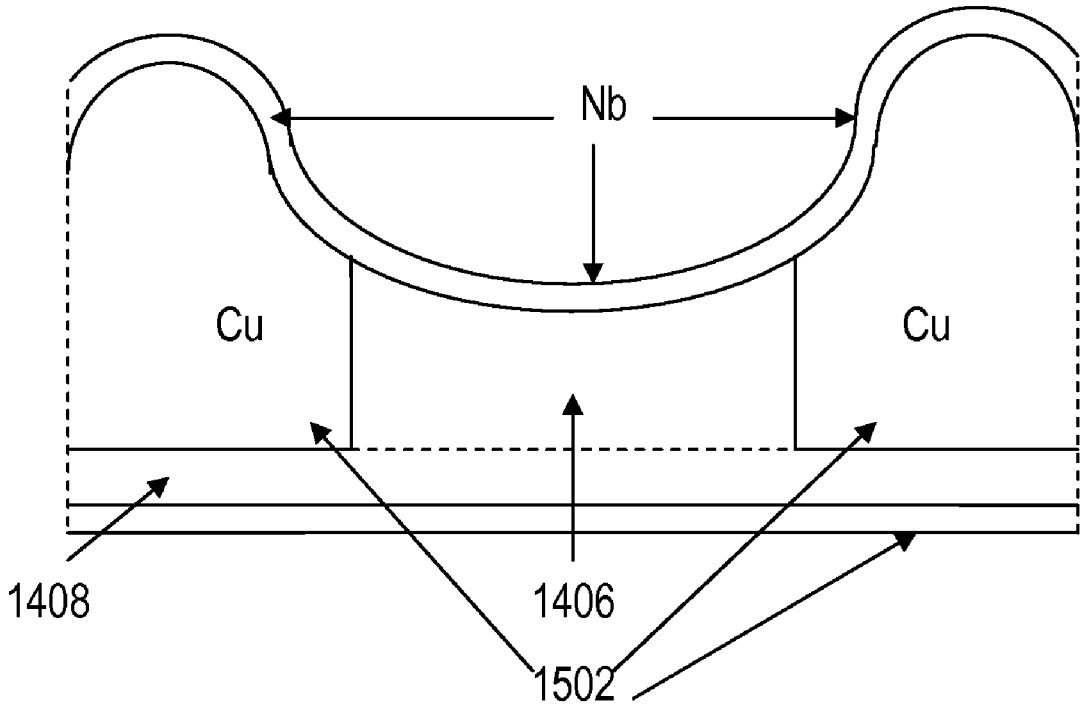
FIG. 15 shows a side view of the alternative polyhedral segment geometry.

FIG. 15 depicts a side view of the alternative polyhedral segment geometry shown in FIG. 14. As shown from the side, the slot 1406 is cut out from around the equator of the cavity, whereas at regions 1502 the copper geometry stands in contact with adjacent polyhedral segments. The cylindrical aperture 1408 runs the entire length of each polyhedral segment in order to couple out the RF power generated by the deflecting modes as was described above.

Figure 16:
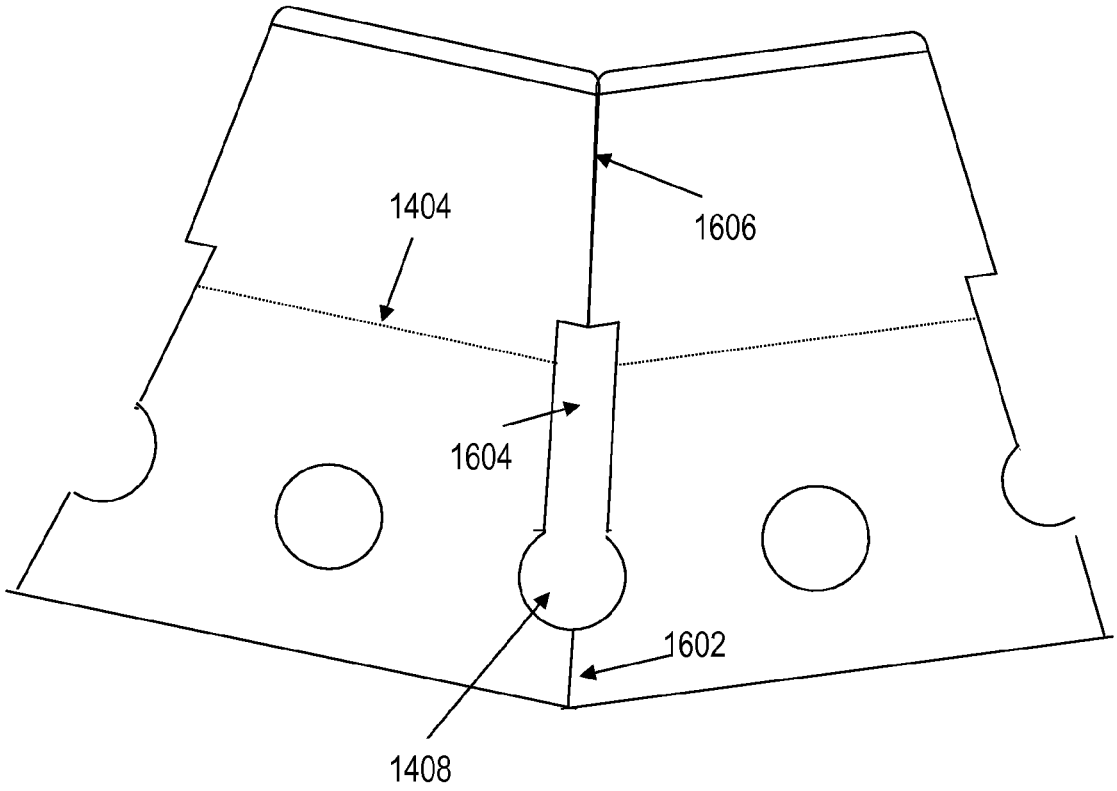
FIG. 16 shows abutting two polyhedral segments of the alternative geometry.

FIG. 16 depicts the abutment of two polyhedral segments using the geometry described in FIGS. 14 and 15. As shown, the abutment of the two segments creates the cylindrical aperture 1408 used for the waveguide. Welds may be made at the intersection of the two copper regions at the exterior of the cavity 1602 as was described above in conjunction with FIG. 12. The mode-coupling channel 1604 generated by the two slots 1406 is for coupling energy from azimuthally oriented currents around the equator of the cavity to the waveguides as was described above. Keeping the inner nose touching along the surface 1606 provides a solid contact for adjacent segments to enable beam symmetrization. FIG. 17 depicts a three-dimensional rendering of the polyhedral segment geometry described in FIGS. 14-16 with a waveguide 1702, the slot 1406, and an intake 1706 for supplying coolant to the cooling channel 1410.

The waveguide 1702 may be designed as an empty cylindrical or ellipsoidal waveguide, a dielectric-loaded cylindrical waveguide, or a coaxial transmission line. Note that other waveguide geometries may also be used. In the case of a non-coaxial waveguide the radius of the waveguide 1702 must be large enough to accommodate the lowest-order deflecting mode above cut-off (for the example of 1.3 GHz accelerating mode, an empty cylindrical waveguide would have a diameter of 10 cm). Having a waveguide 1702 of that size could significantly increase the required size of the linear accelerator cell assembly. Providing a dielectric-loaded waveguide will reduce the required waveguide size for a given cutoff frequency. Using alumina as the dielectric ($\in$=10), for a 1.3 GHz linac structure the radius of the waveguide would be 3.1 cm and fit appropriately into the copper structure, for example. A coaxial transmission line does not exhibit cutoff and so poses no such size restriction; it will transmit any power from the accelerating mode that leaks through the slot apertures. It is noted that while the cylindrical aperture 1408 was provided for creating a waveguide 1702 in each of the segment joints above, the aperture and corresponding waveguide may be formed on only a portion of the segments if desirable.

FIG. 18 depicts a fully assembled linac cavity 1800 using the alternative polyhedral segment geometry. As shown, each of the cooling channels 1410 is supplied with a He supply manifold 1802 and a He return manifold 1804. The waveguides 1702 may be coupled end-to-end using U-joints 1806. It is possible to make such connections while preserving constant impedance and low standing wave ratio (SWR), so that power is transmitted along the succession of waveguides with low loss. The power may then be coupled via the output stems 1808 to an external resistive load. In order to supply the RF currents for generating the accelerating mode, a power coupler 1810 is attached to one end of the linac cavity 1800. Note that another benefit to the having the surface 1606 touching is that the distribution of the power from the power coupler 1810 across each of the segments occurs symmetrically.

Thus a polyhedral cavity fabrication process has been described above. The fabrication process enables alignment of the grain structure of the superconducting material in an axial direction in order to increase the acceleration gradient of each of the cavity cells. Also, since the fabrication generates a plurality of segments with an open geometry a number of surface treatment and quality control measures may be applied to the superconducting material. Once the segments are assembled to form a linac cavity, since the welding occurs on a supporting copper base at some distance from the superconducting material, the treated superconducting surfaces remains unchanged. Since the segments are constructed in an axial direction, they reduce the maximum surface current density in the azimuthally oriented direction and therefore reduce the Q of the deflecting modes. With the superconducting material being bonded to a substantial base of supporting copper, the Lorentz forces do no deform the surface of the superconductor material which prevents Lorentz detuning. Furthermore, one or more cooling channels may be created in the copper in order to eliminate the need for an immersive He bath since the He is instead simply passed through each of the cooling channels.

With the alternative polyhedral segment geometry there is additionally a channel that couples out RF power created by the deflecting modes to a waveguide. The waveguide can then transmit the RF power to a high temperature resistive load and reduce the refrigeration load on the superfluid He. The channel also provides a gap at the equator of the cavity which suppresses surface currents traveling azimuthally across each of the polyhedral segments and therefore reduces the Q of the deflecting modes.

Typically superconducting linear accelerators have been created using Nb since it has many desirable properties among which is that it is a ductile metal. As was mentioned above, the polyhedral segments are started from a flat foil and each segment is completed in an open geometry. Therefore, alternative superconducting materials such as some high-temperature superconductors, may now be considered for use in a linac.

YBCO Cavities

A major limitation on the use of high-temperature superconductors has been their lack of ductility. These materials could offer some benefits for use in accelerator cavities if it were possible to adapt the sheet forms in which these materials are fabricated to the required cavity geometry. In particular the high-temperature superconductor yttrium barium copper oxide ($YBa_2Cu_2O_{7-\delta}$ or YBCO for short) has provided superior performance of superconducting current density and can operate at liquid nitrogen temperature, but the techniques that have been developed to fabricate it in thin films have only been perfected for flat tapes. One example of the multi-layer composition of high-performance YBCO tape is shown in Q. X. Jia et al., "Materials and processes of metal-oxide films for coated conductors", DOE Wire Workshop, St. Petersburg, Fla., Jan. 19-20, 2005. The metal substrate is typically Ni, Hastelloy, or Incolloy, any of which should be compatible with bonding to the copper structure of the polyhedral segments.

YBCO may offer benefits in both cost and performance for superconducting cavities. The accelerating gradient is limited ultimately by the surface current density that can be sustained in the walls of a superconducting cavity. In an example of YBCO, a DC surface current density of ~40 kA/m may be sustained in a ~1 μm thick layer, even when operated at liquid nitrogen temperature. This corresponds to a surface field of $H=4\pi 10^{-3}K=500Oe$, about half the nominal DC surface field limit for Nb. Just as with Nb, the actual maximum surface field would be limited by the dynamics of flux penetration. The corresponding ultimate accelerating gradient for the polyhedral structure using YBCO thus may be comparable to, greater than, or less than that in pure Nb.

Figure 21:
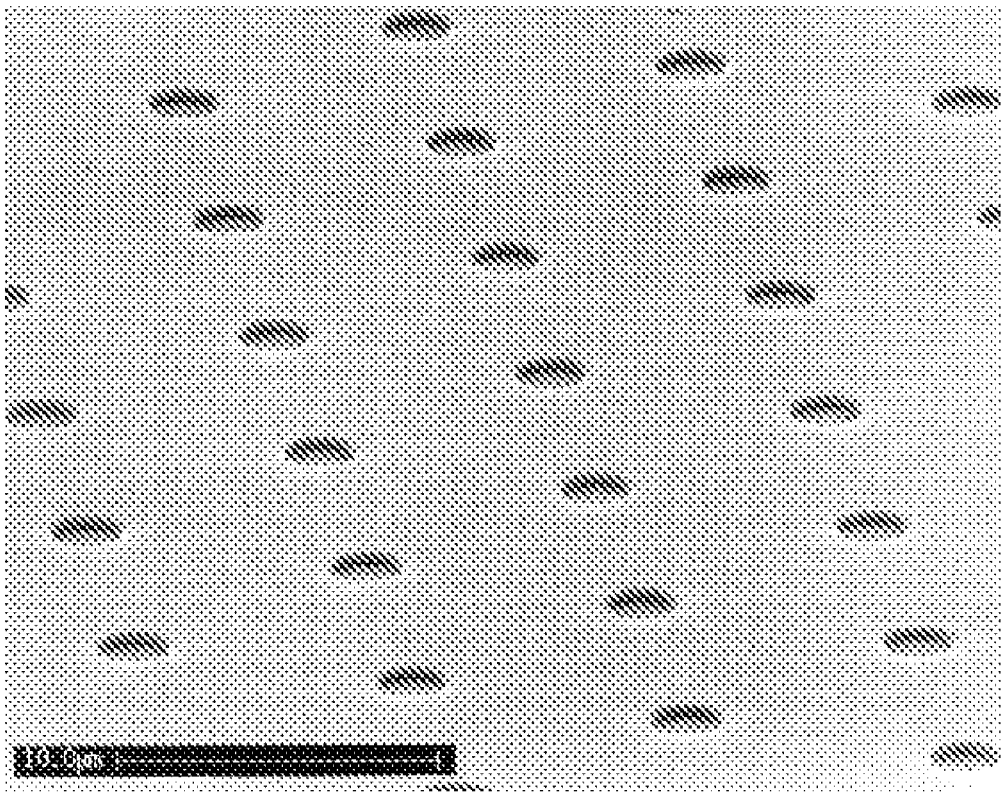
FIG. 21 shows a pattern of micro-dots on the surface of a superconducting material.

The RF surface resistance can be improved by patterning the surface with nano-dots as shown in FIG. 21. The nano-dots provide flux pinning. This technique of patterning has been tested on the surface of the YBCO strips. While described here in conjunction with YBCO, the use of the nano-dots may be applied to any other superconducting material such as Nb or $Nb_3Sn$.

The techniques for fabricating YBCO have been developed for the fabrication of flat tape, which can be employed in the polyhedral cavity fabrication process described above. A primary benefit of YBCO is its high operating temperature. The transport properties of YBCO are largely optimum for temperature around one-third of the 90 K critical temperature. Operation at around 30 K could be supported using Ne refrigeration. The capital cost and operating cost for Ne refrigeration would be reduced by around a factor of 100 compared with superfluid helium. At an operating temperature of 30 K, a cavity would exhibit dramatically greater thermal stability under micro-quenches, so that current would have some margin of time to re-distribute and in some cases a quench would not propagate.

There are a number of applications that require high-power beams of electrons with kinetic energy of around 5-1000 MeV. Examples are food irradiation, X-ray lithography, industrial wastewater treatment, and polymer cross-linking. While there is now high-efficiency, low-capital cost technology available to generate high-power electron beams with kinetic energy less than 2 MeV, there is currently no such appropriate technology for generating high-power beams of higher kinetic energy.

Polyhedral YBCO cavities offer an appropriate match to such requirements. The linac cavities using YBCO could be operated at 77 K (the temperature of liquid nitrogen which is widely available at industrial sites) with a degradation of surface resistance of only a factor of around 3. Thus the polyhedral YBCO cavity assembly could provide access to high-power, high-energy electron beams in a much more cost-effective system than any previous technical approach.

$Nb_3Sn$ Cavities

The development to date of superconducting cavities using solid Nb has reached a high degree of performance, so that the maximum attained resonant field produces a surface magnetic field close to the limit for the pairing current (the so-called BCS limit) of Nb. Nb is a Type I superconductor: magnetic fields are excluded from the surface in an ideal Meissner effect for magnetic fields lower than the lower critical field $H_{c1}$ ~0.2 T, and the upper critical field $H_{c2}$ at which superconductivity is destroyed altogether is only a little larger than $H_{c1}$. While the improvements are achieved with the polyhedral segment structure to relieve some of the most challenging issues regarding the realistic manufacture of high-performance cavities using Nb surfaces, it may be desirable to explore the use of other superconducting materials to enable significant increases in the maximum accelerating gradient.

Alex Gurevic discloses in "Enhancement of RF Breakdown Field of Superconductors by Multilayer Coating", Applied Physics Letters 88, 012511, hereby incorporated by reference, that it may be possible to dramatically increase the attainable gradient by altering the surface material. Specifically he considers the effect of depositing multiple thin films of the Type II superconducting alloy $Nb_3Sn$ on an Nb foil substrate, with the thickness of each film less than the London penetration depth λ (the depth to which magnetic field can penetrate into a Type II superconductor, 80 nm for $Nb_3Sn$). A Type II superconductor exhibits the Meissner effect up to the lower critical field $H_{c1}$, but for higher fields some magnetic flux (and some current) can penetrate the surface. It has been thought that this penetration would lead to creation of flux vortices in the presence of RF currents and pose severe limits on superconducting performance. Gurevich shows that such vortices should be suppressed providing that the $Nb_3Sn$ film is kept thinner than λ and providing that successive $Nb_3Sn$ films are separated by thin dielectric layers. Each $Nb_3Sn$ layer serves as a magnetic shield to stepwise reduce the flux penetrating to the next layer, so that 3 such layers should permit operation with a peak surface RF field that was ten times larger than that for a pure Nb surface. This benefit should persist up to a limit posed by the thermodynamic critical field $H_t$ of $Nb_3Sn$ (~0.5 T), potentially yielding a factor three greater accelerating gradient than has ever been achieved in a superconducting cavity.

In order to realize such a multi-layer thin film, the layers of $Nb_3Sn$ and dielectric can be applied in an open geometry, using processes such as evaporation, RF sputtering, chemical vapor deposition, or physical vapor deposition. The open geometry afforded by the polyhedral segments provides open access to the inner surface of the each segment so that the films can be applied and characterized.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

The bulk of the present disclosure has focused on applications to particle accelerators. Other applications exist which may benefit from the use of a high-Q microwave cavities having a polyhedral construction that provides for selective suppression of HOM and enables construction with high-temperature superconductors and materials with customized surfaces and grain structure orientations. Such applications may include communication systems, active radar systems, materials testing systems, and ion-based propulsion systems, to name just a few.

Also, techniques, systems, subsystems and methods described and illustrated in the various embodiments as discrete or separate may be combined or integrated with other systems, modules, techniques, or methods without departing from the scope of the present disclosure. Other items shown or discussed as directly coupled or communicating with each other may be coupled through some interface or device, such that the items may no longer be considered directly coupled to each other but may still be indirectly coupled and in communication, whether electrically, mechanically, or otherwise with one another. Other examples of changes, substitutions, and alterations are ascertainable by one skilled in the art and could be made without departing from the spirit and scope disclosed herein.

What is claimed is:

1. A particle accelerator that comprises:

a path that transports charged particles from a particle source; and at least one high-frequency electromagnetic wave resonator, said resonator including a cavity that is circumferentially polyhedral having azimuthally flat surfaces.

2. The particle accelerator of claim 1, wherein the resonator comprises a plurality of polyhedral segments.

3. The particle accelerator of claim 2, wherein each of the polyhedral segments comprises a superconducting material bonded to a thermally and electrically conductive supporting base.

4. The particle accelerator of claim 3, wherein each supporting base incorporates at least one unlined passage for cryogenic coolant.

5. The particle accelerator of claim 3, wherein the superconducting material is rounded over at each edge for an adjoining face of the polyhedral segment.

6. The particle accelerator of claim 3, wherein the supporting bases of the polyhedral segments are configured to contact each other around each opening to the cavity while leaving a controlled-width gap between adjacent segments at each equator of the cavity.

7. The particle accelerator of claim 6, wherein the supporting bases of the polyhedral segments are further configured to contact each other at an external surface of the resonator.

8. The particle accelerator of claim 3, wherein adjoining faces of at least two polyhedral segments form a mode-coupling channel configured to extract deflection mode energy from the cavity.

9. The particle accelerator of claim 8, further comprising a waveguide configured to route deflection mode energy from the mode-coupling channel to a resistive load.

10. The particle accelerator of claim 9, wherein the resistive load is maintained at room temperature.

11. The particle accelerator of claim 9, wherein the waveguide is elliptical.

12. The particle accelerator of claim 9, wherein the waveguide contains a dielectric material.

13. The particle accelerator of claim 9, wherein the waveguide contains a central coaxial conductor.

14. The particle accelerator of claim 9, wherein the resistive load is maintained at a temperature that is greater than that of the cavity structure.

15. The particle accelerator of claim 3, wherein the polyhedral segments are joined without chemically affecting any of the superconducting material.

16. The particle accelerator of claim 3, wherein the superconducting material comprises YBCO.

17. The particle accelerator of claim 3, wherein the superconducting material comprises one or more layers of $Nb_3Sn$ on an Nb substrate.

18. The particle accelerator of claim 3, wherein the superconducting material is a high temperature superconductor.

19. The particle accelerator of claim 3, wherein the superconducting material comprises one or more layers of a type II superconductor on an Nb substrate.

20. The particle accelerator of claim 2, wherein each of the polyhedral segments comprises a superconductive material having a grain structure that is aligned with a long axis of the resonator.

21. The particle accelerator of claim 2, wherein the segments are joined to substantially enclose the cavity, leaving at least one iris opening on a central axis of the cavity.

* * * * *